US007188615B2

(12) United States Patent
Chang

(10) Patent No.: US 7,188,615 B2
(45) Date of Patent: Mar. 13, 2007

(54) ADJUSTABLE CAM FOR A CROSSBOW

(75) Inventor: Chu-Wei Chang, Feng-Yuan (TW)

(73) Assignee: Poe Lang Enterprise Co., Ltd., Taichung Hsien (TW)

( * ) Notice: Subject to any disclaimer, the term of this patent is extended or adjusted under 35 U.S.C. 154(b) by 64 days.

(21) Appl. No.: 11/047,718

(22) Filed: Feb. 2, 2005

(65) Prior Publication Data

US 2006/0169260 A1 Aug. 3, 2006

(51) Int. Cl.
*F41B 5/10* (2006.01)
*F41B 5/12* (2006.01)

(52) U.S. Cl. ..... 124/25.6; 124/25; 124/900

(58) Field of Classification Search ..... 124/25, 124/25.6, 900
See application file for complete search history.

(56) References Cited

U.S. PATENT DOCUMENTS 4,967,721 A * 11/1990 Larson ..... 124/25.6
5,960,778 A * 10/1999 Larson ..... 124/25.6
6,082,347 A * 7/2000 Darlington ..... 124/25.6
6,250,293 B1 * 6/2001 Andrews ..... 124/25.6
6,360,735 B1 * 3/2002 Larson et al. ..... 124/25.6
6,575,153 B2 * 6/2003 Lommasson et al. ..... 124/25.6
6,691,692 B1 * 2/2004 Adkins ..... 124/25.6

* cited by examiner

*Primary Examiner*—John A. Ricci
(74) *Attorney, Agent, or Firm*—Bacon & Thomas, PLLC

(57) ABSTRACT

An adjustable cam for a crossbow has a main disk, a weight-adjusting block and a length-adjusting block. The main disk has two sides, a group of string hooks, a group of weight-selecting holes, and a group of length-selecting holes. The group of string hooks is formed on one side of the main disk. The group of weight-selecting holes and the group of length-selecting holes are defined through the main disk in different areas. The weight-adjusting and the length-adjusting blocks are pivotally and coaxially mounted on the other side of the main disk. Each block has a securing hole to engage the one hole in a corresponding group. By attaching a bowstring to different string hooks and engaging the blocks to the corresponding hole in the groups, tension degrees and draw lengths are adjustable in various modifications to make the crossbow have versatile options to satisfy different users.

7 Claims, 8 Drawing Sheets

ADJUSTABLE CAM FOR A CROSSBOW

BACKGROUND OF THE INVENTION

1. Field of the Invention

The present invention relates to an adjustable cam for a crossbow, and more particularly to an adjustable cam that is used to adjust tension degrees and draw lengths of bowstrings on the crossbow.

2. Description of Related Art

Conventionally, a crossbow usually contains a bow assembly, at least one bowstring and two cams. The two cams are respectively attached to two distal ends of the bow assembly to reel the bowstring when the crossbow is drawn to shoot an arrow. Therefore, the cams are used to only provide guiding efficiency to hold the bowstring steady when the crossbow is operated and do not provide any adjusting capability to the crossbow. Each crossbow has particular bowstring tension and draw length so that the crossbow is only suitable for a specific person and is seldom suitable for use by someone else having different physical condition.

To overcome the shortcomings, the present invention provides an adjustable cam for the crossbow to obviate the aforementioned problems.

SUMMARY OF THE INVENTION

The main objective of the invention is to provide an adjustable cam that adjusts the bowstring to have different tension degrees and draw lengths.

Other objects, advantages and novel features of the invention will become more apparent from the following detailed description when taken in conjunction with the accompanying drawings.

DETAILED DESCRIPTION OF PREFERRED EMBODIMENT

An adjustable cam for a crossbow in accordance with the present invention comprises a main disk, a weight-adjusting block and a length-adjusting block. The main disk has two sides, a group of string hooks, a group of weight-selecting holes, and a group of length-selecting holes. The group of string hooks is formed on one side of the main disk. The group of weight-selecting holes and the group of length-selecting holes are defined through the main disk in different areas. The weight-adjusting block and the length-adjusting blocks are pivotally and coaxially mounted on the other side of the main disk. Each block has a securing hole to engage the one hole in a corresponding group.

By selectively attaching a bowstring to different string hooks and engaging the blocks to the corresponding groups of holes, tension degrees and draw lengths of the crossbow are adjustable in various modifications to make the crossbow have more versatile options to satisfy different users.

Figure 1:
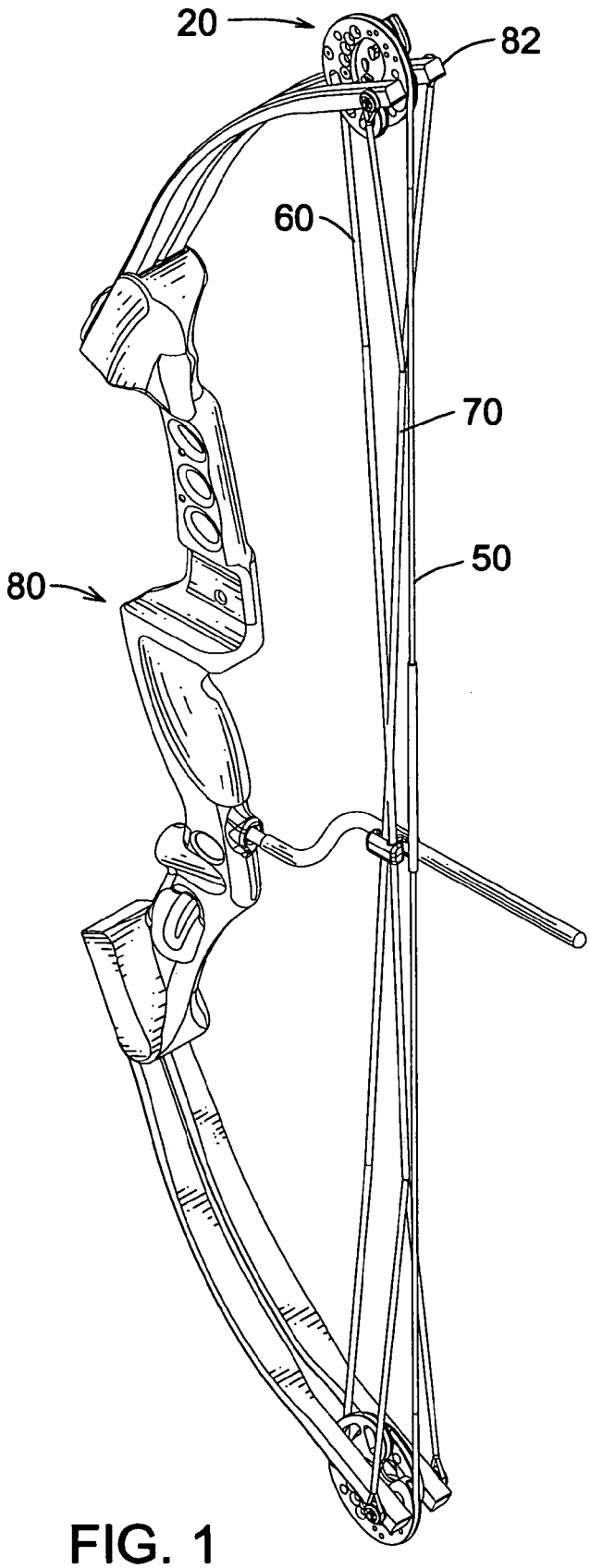
FIG. 1 is a perspective view of a crossbow with two adjustable cams in accordance with the present invention.
Figure 2:
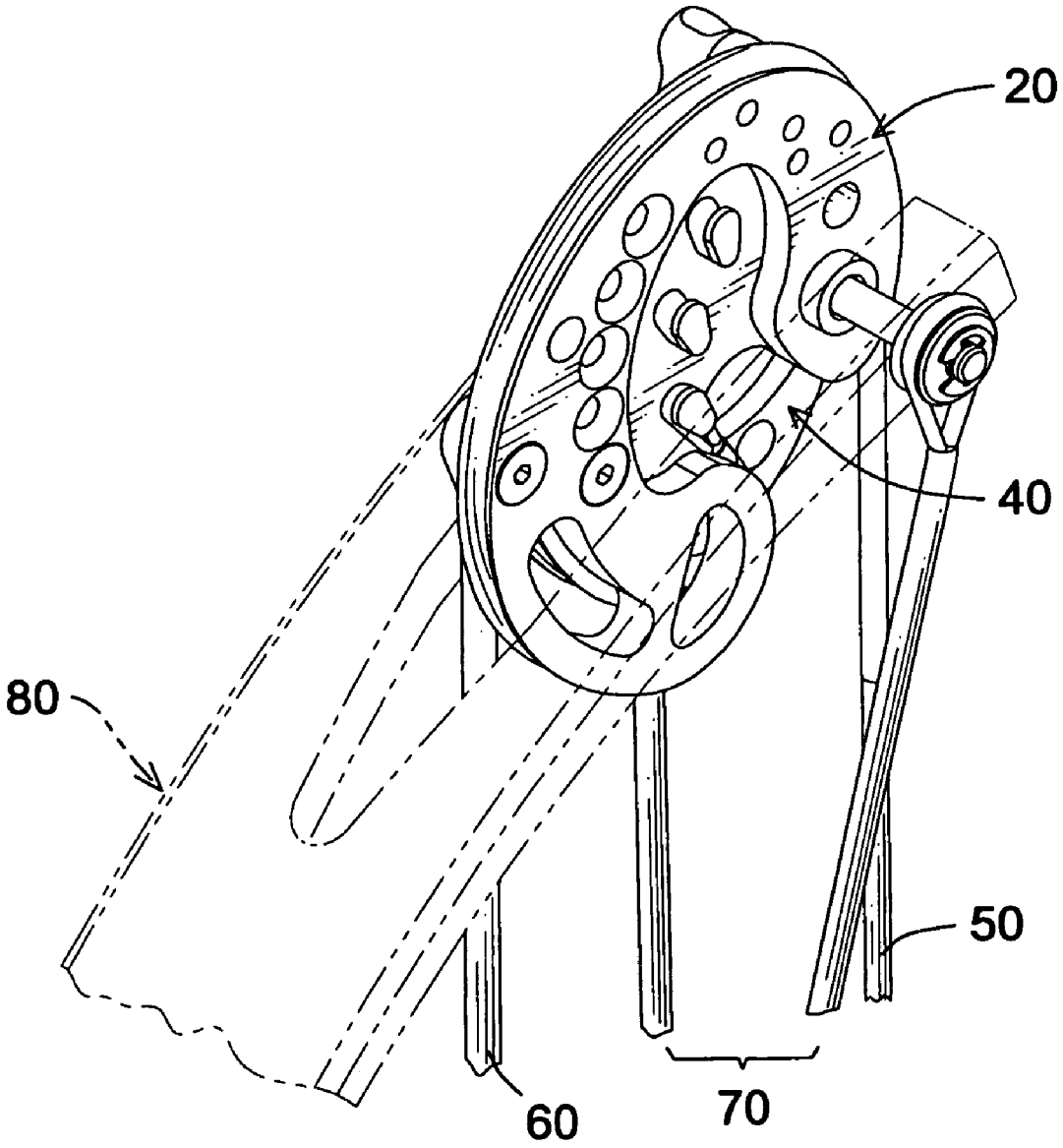
FIG. 2 is an enlarged perspective view of the crossbow showing the adjustable cam at an upper end of the crossbow in FIG. 1.

With reference to FIGS. 1 and 2, two preferred embodiments of the adjustable cams in the present invention are adapted to attach to a crossbow (80) with triple bowstrings including an outer bowstring (50) and two inner bowstrings (60, 70). The two adjustable cams in the crossbow are symmetrical and each adjustable cam is rotatably mounted on a bracket (82) of the crossbow (80). Wherein, only the outer bowstring (50) and one inner bowstring (60) are directly attached to elements of the adjustable cam. The other inner bowstring (70) is diverged at one end to secure on two sides of the bracket (82) of one adjustable cam and extends to be attached to the opposite adjustable cam at the other end. Thereby, when the outer bowstring (50) is drawn out, the adjustable cams rotate to release the outer bowstring (50) and reel the two inner bowstrings (60, 70) up on the adjustable cams so that the crossbow (80) is contracted in height to store force for shooting arrows.

Figure 3:
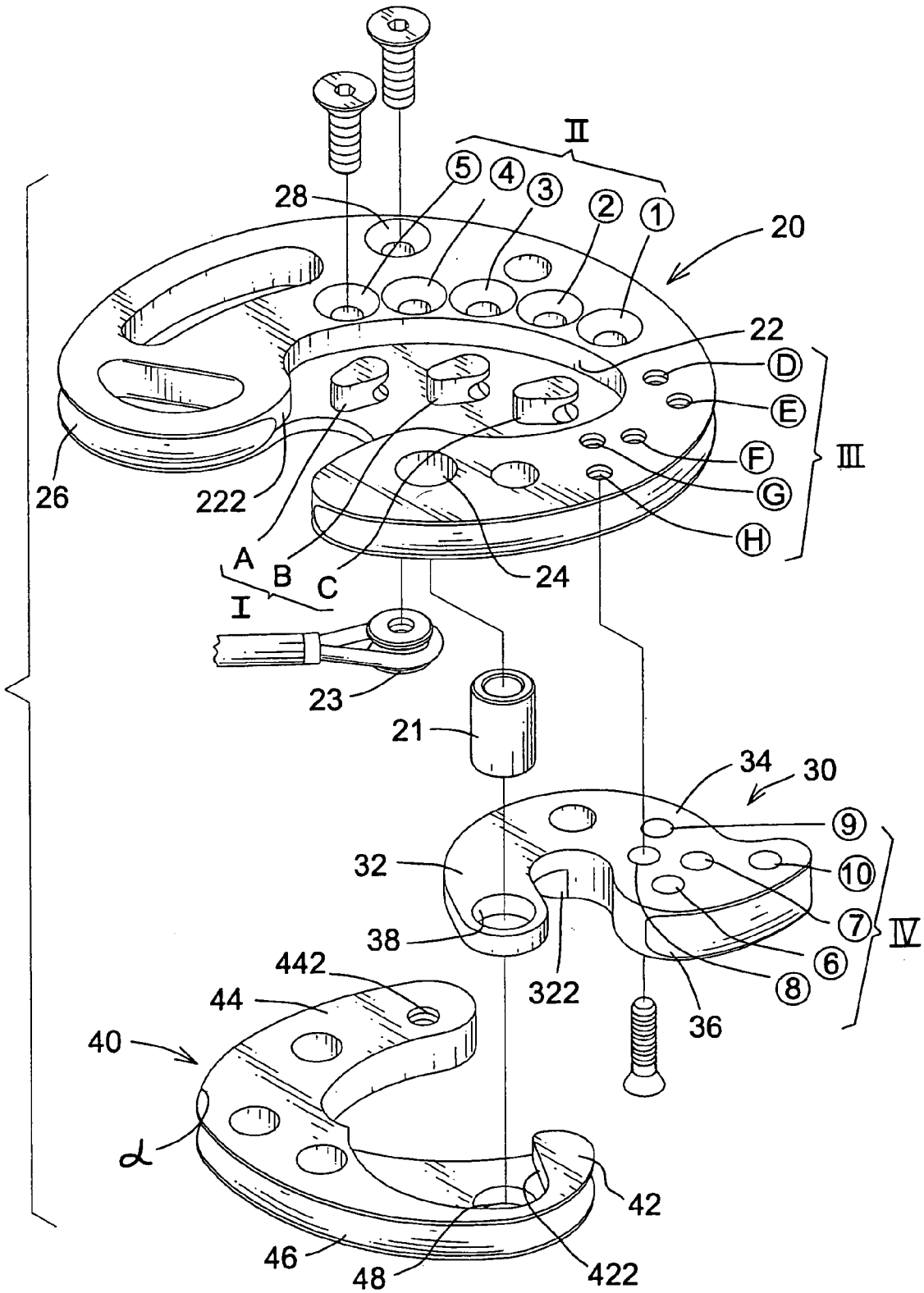
FIG. 3 is an exploded perspective view of the adjustable cam.
Figure 4:
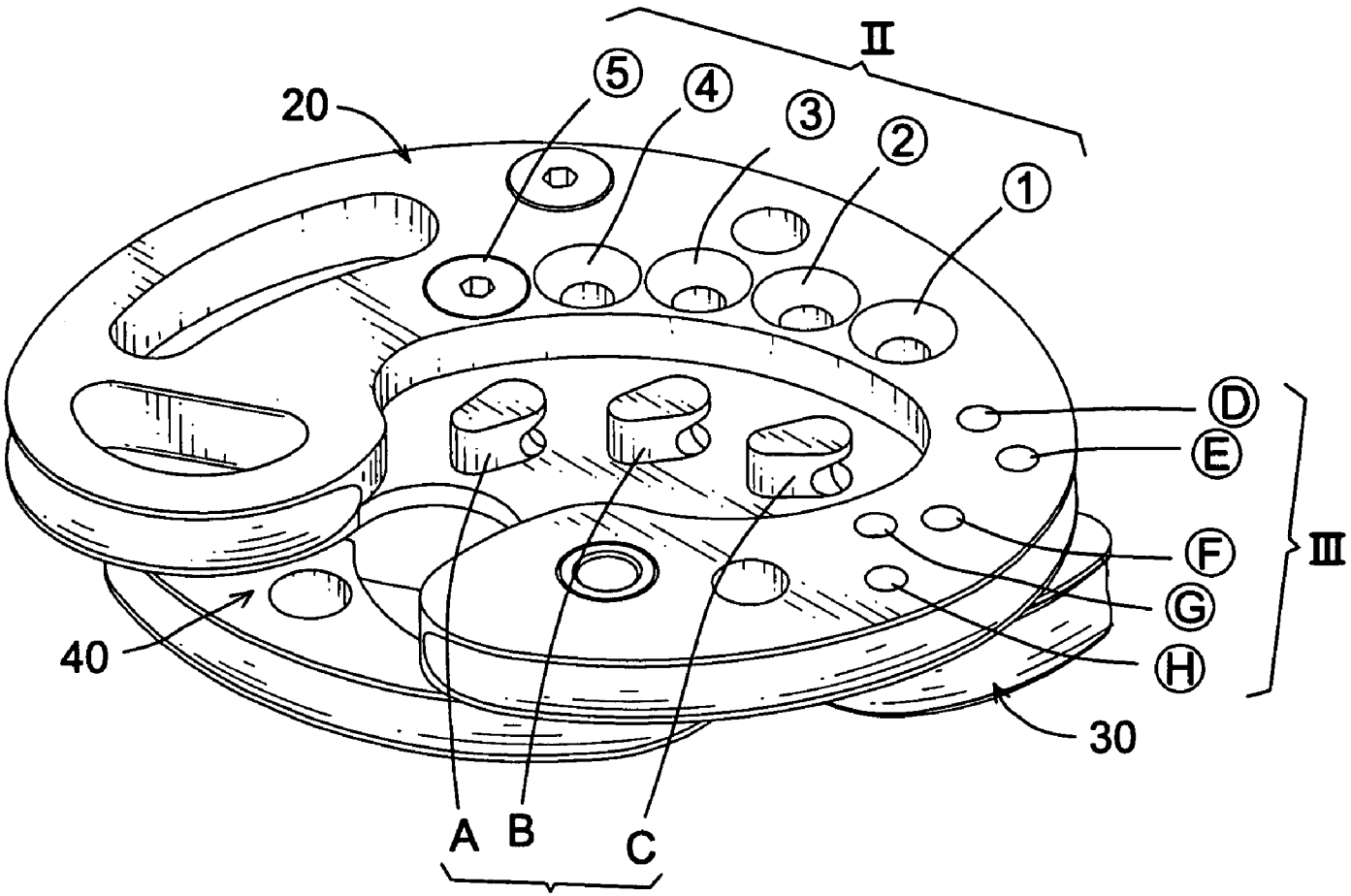
FIG. 4 is a perspective view of the adjustable cam.

With reference to FIGS. 3 and 4, take the adjustable cam mounted on an upper end of the crossbow (80) as an example, the adjustable cam comprises a main disk (20), a length-adjusting block (30), a weight-adjusting block (40) and a pivotal rivet (21). The pivotal rivet (21) penetrates the main disk (20), the length-adjusting block (30) and the weight-adjusting block (40) to compose the adjustable cam and adapts to be mounted on the bracket (82) of the crossbow (80).

The main disk (20) is a kidney-shaped plate and has two sides, an edge periphery, a recess (22), a pivotal hole (24), a string rail (26), a mounting hole (28), a group of string hooks (I), a group of weight-selecting holes (II) and a group of length-selecting holes (III). The recess (22) is defined in one side of the main disk (20) and extends to the edge periphery to provide an opening (222) and make the main disk (20) have a C-shaped platform on the side. The C-shaped platform has two ends and the pivotal hole (24) is defined in one end of the C-shaped platform. The string rail (26) is formed on the edge periphery around the main disk (20) until the string rail (26) closes the opening (222) of the recess (22).

The group of string hooks (I) includes three string hooks (code: A, B, C) arranged in a curved line. The three string hooks (code: A, B, C) are formed on the main disk (20) inside the recess (22). The group of weight-selecting holes (II) is composed of five weight-selecting holes (No. 1, 2, 3, 4, 5) arranged in a curved line on the C-shaped platform. The weight-selecting holes (II) are arranged substantially in parallel with the string hooks (I). Additionally, the mounting hole (28) is defined through the C-shaped platform near the No. 4 weight-selecting hole. A string wheel (23) is secured on the mounting hole (28) by means of a screw.

The group of length-selecting holes (III) is composed of five length-selecting holes (code: D, E, F, G, H) arranged in same radius paths relative to the length-adjustable block (30) and close to the pivotal hole (24).

Particularly referring to FIG. 3, the length-adjusting block (30) is pivotally mounted on the other side of the main disk (20) opposite to the recess (22) by the pivotal rivet (21) and partially clamped between the main disk (20) and the weight-adjusting block (40). The length-adjusting block (30) is substantially an S-shaped plate and has a pivotal end (32), an engaging end (34), an exterior edge, a string groove (36), a pivotal hole (38), a sunken area (322) and a group of length-matching holes (IV). The sunken area (322) is defined at the pivotal end (32) to face the weight-adjusting block (40) and the pivotal hole (38) is defined through at the pivotal end (32) within the sunken area (322). The exterior edge is formed at a distal portion of the engaging end (34). The string groove (36) is defined at the exterior edge. The group of length-matching holes (IV) is composed of five length-matching holes (No. 6, 7, 8, 9, 10) arranged to correspondingly align with the length-selecting holes (Code: D, E, F, G, H) on the main disk (20).

The weight-adjusting block (40) is pivotally mounted on the main disk (20) and partially overlapped with the length-adjusting block (30). The weight-adjusting block (40) is substantially a C-shaped plate and has an outer edge, an inner edge, a zenith (α), a pivotal end (42), an engaging end (44), a string rail (46), a sunken area (422), a pivotal hole (48) and a mounting hole (442). The sunken area (422) is defined at the pivotal end (42) to engage with the sunken area (322) on the length-adjusting block (30). The sunken area (422) gradually broadens and extends to the inner edge so that the sunken area (422) allows the length-adjusting block (30) to pivot freely when the engagement of the length-adjusting block (30) with the main disk (20) is changed. The string rail (46) is formed on the outer edge of the weight-adjusting block (40). The mounting hole (442) is defined in the engaging end (44) to selectively align with the group of weight-selecting holes (No. 1, 2, 3, 4, 5) by pivotally securing the weight-adjusting block (40) on the main disk (20).

The modifications of the adjustable cam are complex because interactions between elements of the adjustable cam are various. Therefore, the following table demonstrates all modifications of the adjustable cam and the corresponding tensile degrees and draw lengths for further illustration about the preferred embodiment shows in the drawings.

| [I] | [II] | lbs | Draw length (inch) [III, IV] | | | | | | | Brace Height |
|---|---|---|---|---|---|---|---|---|---|---|
| A | 1 | 40 | 26 | 26.5 | 27 | 27.5 | 28 | 28.5 | | 8 |
| | | | 8H | 9F | 8G | 6H | 7F | 6G | | |
| | 2 | 46 | 26 | 26.5 | 27 | 27.5 | 28 | 28.5 | 29 | |
| | | | 8H | 9F | 8G | 7F | 6G | 10E | 10D | |
| | 3 | 51 | 27.5 | 28 | 28.5 | 29 | 29.5 | | | |
| | | | 6H | 7F | 6G | 10E | 10D | | | |
| | 4 | 54 | 28 | 28.5 | 29 | 29.5 | | | | |
| | | | 7F | 6G | 10E | 10D | | | | |
| | 5 | 60 | 29 | 29.5 | 30 | | | | | |
| | | | 6G | 10E | 10D | | | | | |
| B | 1 | 48 | 26.5 | 27 | 27.5 | 28 | 28.5 | 29 | | 7(¾)" |
| | | | 8H | 9F | 8G | 6H | 7F | 6G | | |
| | 2 | 50 | 26.5 | 27 | 27.5 | 28 | 28.5 | 29 | 29.5 | |
| | | | 8H | 9F | 8G | 7F | 6G | 10E | 10D | |
| | 3 | 54 | 28 | 28.5 | 29 | 29.5 | 30 | | | |
| | | | 6H | 7F | 6G | 10E | 10D | | | |
| | 4 | 58 | 28.5 | 29 | 29.5 | 30 | | | | |
| | | | 7F | 6G | 10E | 10D | | | | |
| | 5 | 62 | 29.5 | 30 | 30.5 | | | | | |
| | | | 6G | 10E | 10D | | | | | |
| C | 1 | 54 | 27 | 27.5 | 28 | 28.5 | 29 | 29.5 | | 1(½)" |
| | | | 8H | 9F | 8G | 6H | 7F | 6G | | |

-continued

| [I] | [II] | lbs | Draw length (inch) [III, IV] | | | | | | | Brace Height |
|---|---|---|---|---|---|---|---|---|---|---|
| | 2 | 56 | 27 | 27.5 | 28 | 28.5 | 29 | 29.5 | 30 | |
| | | | 8H | 9F | 8G | 7F | 6G | 10E | 10D | |
| | 3 | 58 | 28.5 | 29 | 29.5 | 30 | 30.5 | | | |
| | | | 6H | 7F | 6G | 10E | 10D | | | |
| | 4 | 62 | 29 | 29.5 | 30 | 30.5 | | | | |
| | | | 7F | 6G | 10E | 10D | | | | |
| | 5 | 65 | 30 | 30.5 | 31 | | | | | |
| | | | 6G | 10E | 10D | | | | | |

Figure 5:
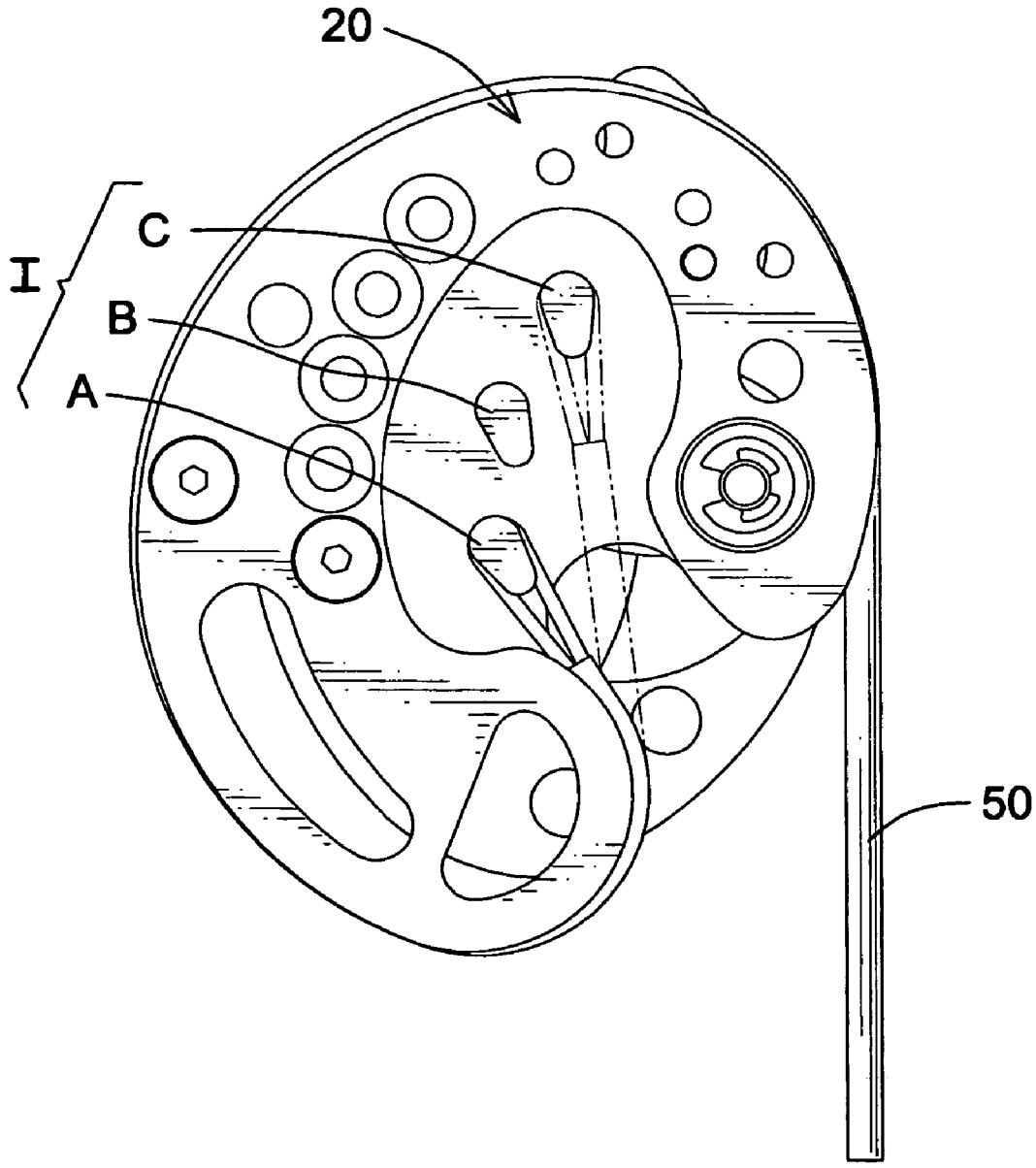
FIG. 5 is an operational side view of the adjustable cam in FIG. 2, wherein an outer bowstring is selectively attached to different string hooks.

With reference to FIG. 5 and the table, a crossbow user has to decide on a desired tension degree firstly. Taking 60 lbs as the desired tension degree for example, the outer string (50) has to attach to the string hook of A. However, the outer string (50) is enabled to selectively attach to other hooks of B or C under other desired tension degrees.

Figure 6:
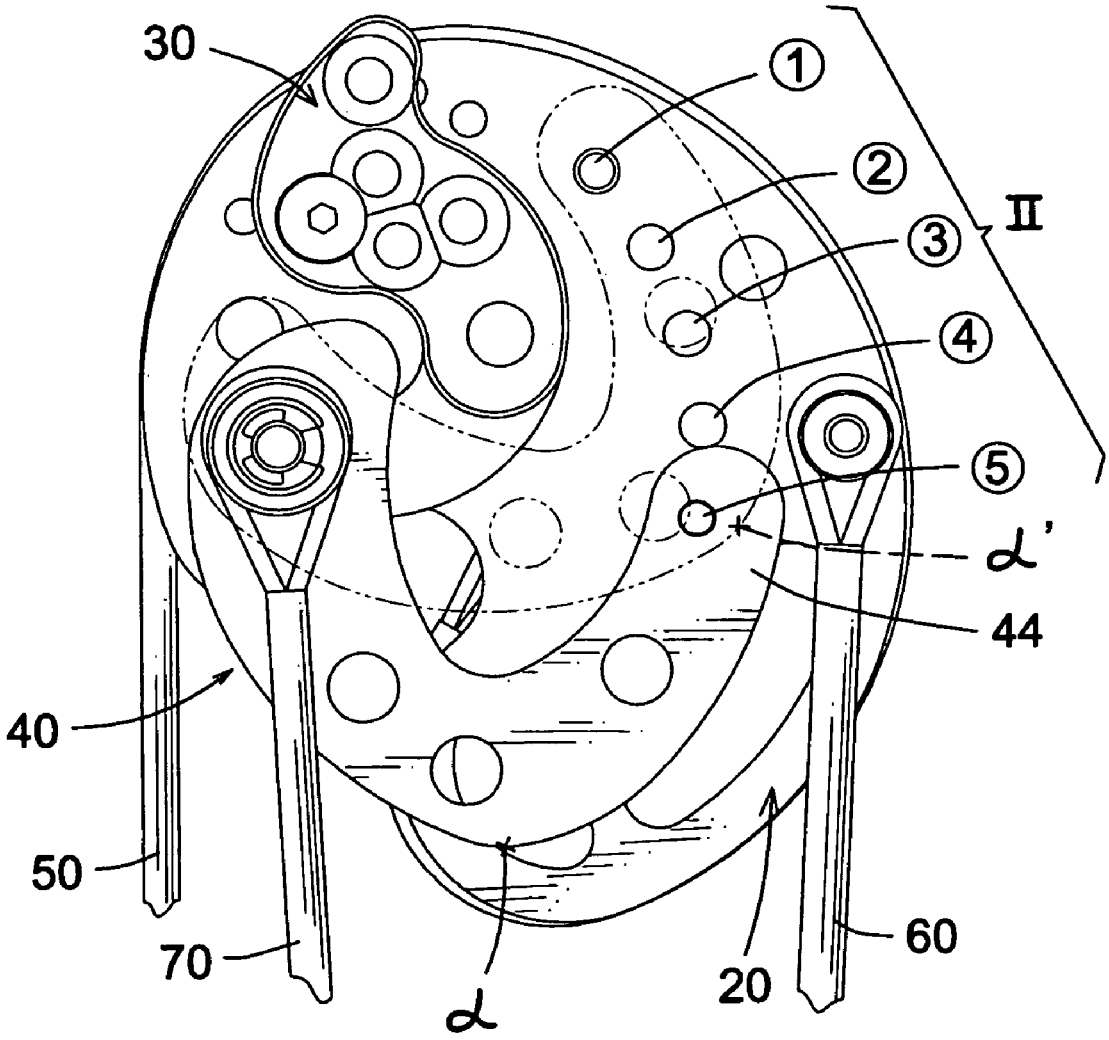
FIG. 6 is another operational side view of the adjustable cam in FIG. 2, wherein a weight-adjusting block is selectively secured on a main disk at different positions.

After attaching the outer bowstring (50) on the string hook of No. A, the mounting hole (442) aligns with the weight-selecting hole of No. 5. As shown in FIG. 6, when the mounting hole (442) mounts over different weight-selecting holes from No. 5 To No. 1 for different desired tension degrees, the zenith (α, α') moves gradually toward the inner bowstring (60). Therefore, when the mounting hole (442) aligns with the weight-selecting hole of No. 1, the inner bowstring (60) can be easier received inside the string rail (46) on the weight-adjusting block (40) than when the mounting hole (422) aligns the weight-selecting hole of No. 5. Because the zenith (α) becomes closer to the inner bowstring (60), only small effort is needed to make the inner bowstring (60) overcome the resistance to pass the zenith (α). According to the table, the tension degrees correspondingly decrease from 60 lbs to 40 lbs when the mounting hole (422) moves from alignment with No. 5 to No. 1 to adjust the tension degrees shown in weight.

Figure 7:
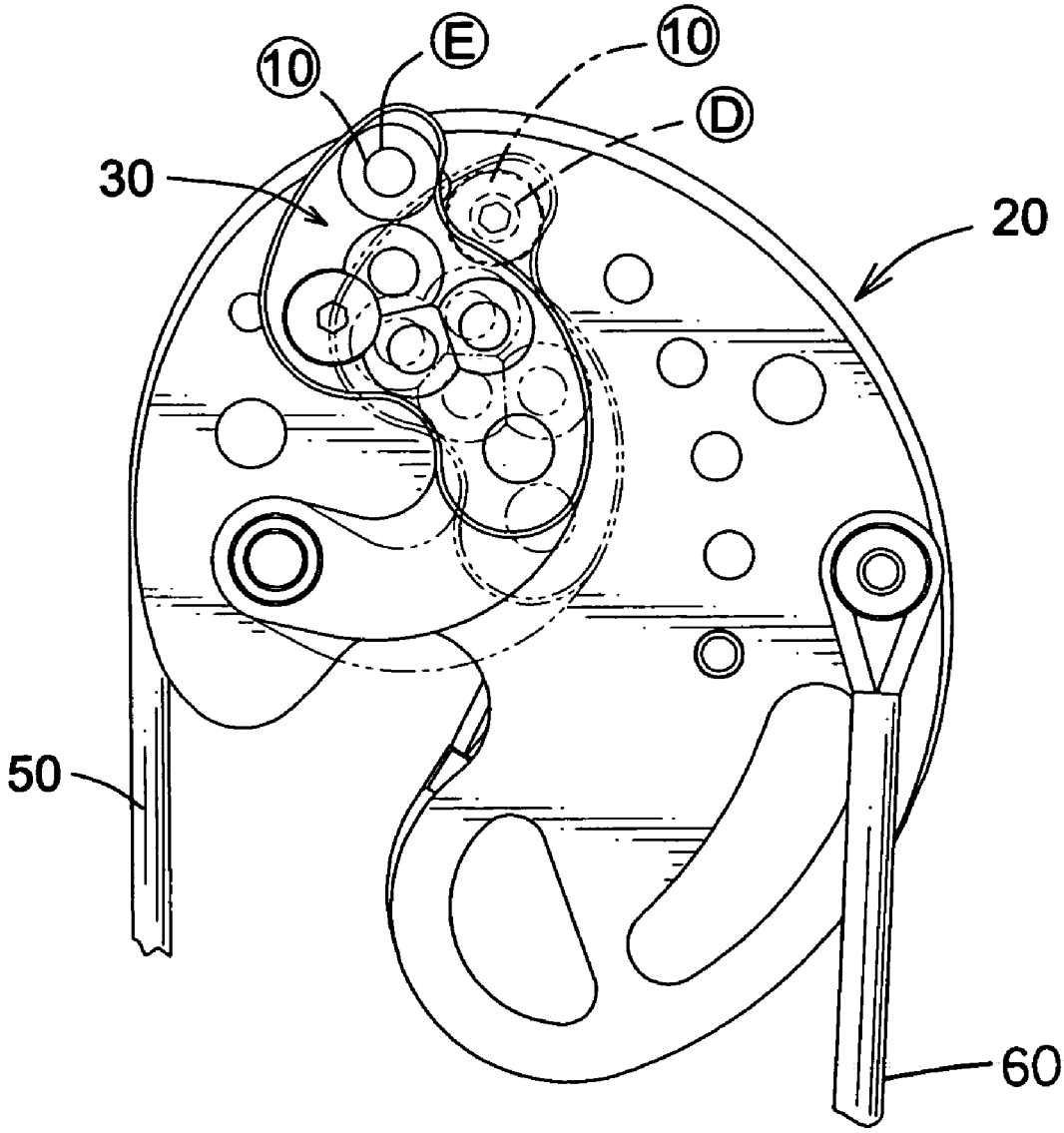
FIG. 7 is still another operational side view of the adjustable cam in FIG. 2, wherein a length-adjusting block is selectively secured on the main disk at different positions.

Secondly, the user has to decide a desired draw length according to arm length. Take 29.5 inch as the desired draw length under the desired tension of 60 lbs as an example, the length-matching hole No. 10 on the length-adjusting block (30) has to specifically align with the length-selecting hole of code E on the main disk (20) according to the table. With reference to FIG. 7, the length-matching hole of No. 10 on the length-adjusting block (30) also can selectively and specifically align with the length-selecting hole of code E on the main disk (20) so that the draw length is adjusted to 30 inches (see the table).

Figure 8:
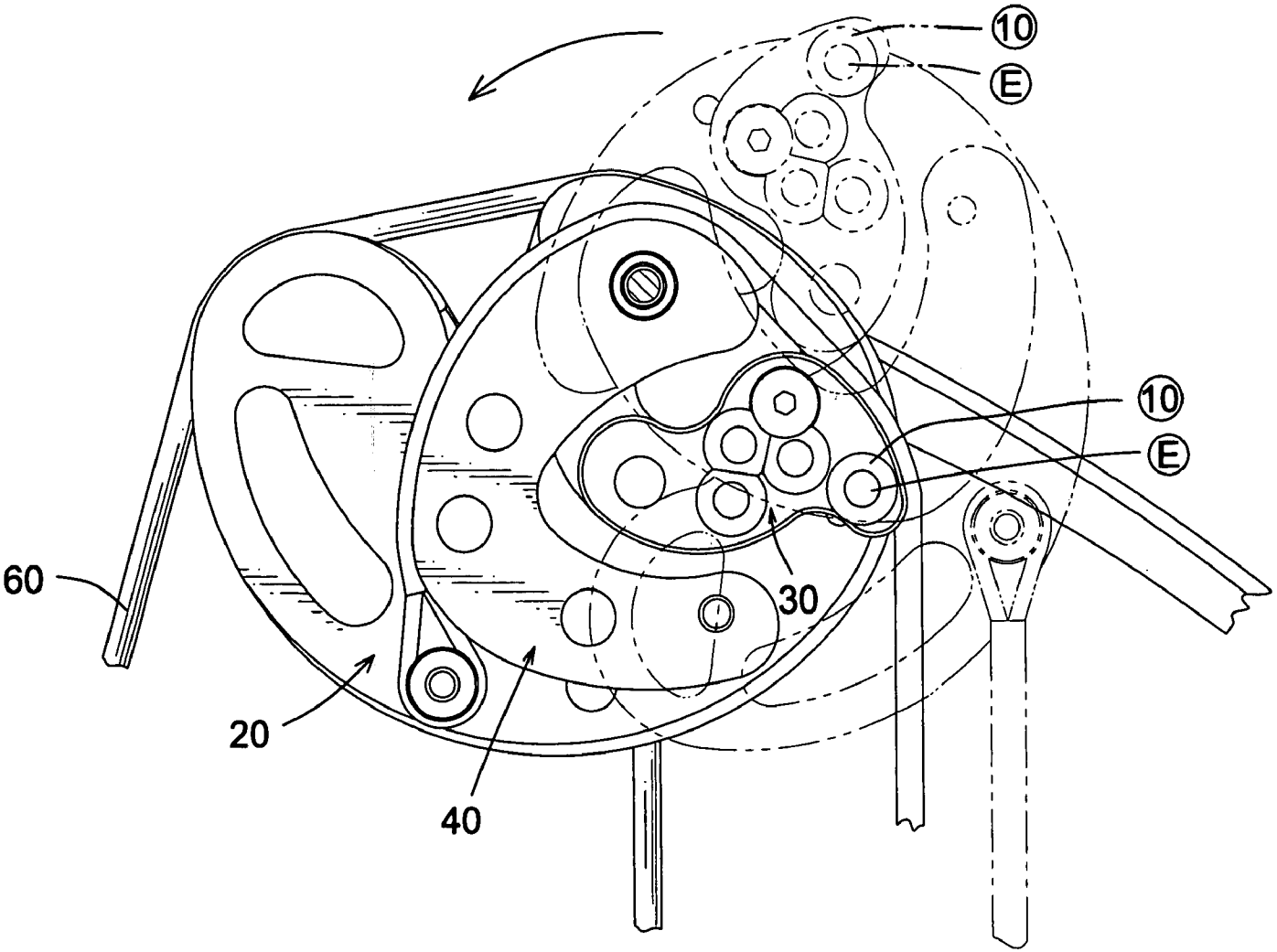
FIG. 8 shows the movements of the adjustable cam that rotates to reel an inner bowstring by the weight-adjusting block and the length-adjusting blocks.

With further reference to FIG. 8, the inner string (60) is received in the string rail (46) on the weight-adjusting block (20) and then enters the string to groove (36) on the length-adjusting block (30) when the adjustable cam rotates. Therefore, the inner string (60) at the modification of 10E has a longer path surrounding the blocks (20, 30) then one at the modification of 10D since the exterior edge protrudes farther. Therefore, inner string (60) become tense so that the outer string (50) is drawn less when the tension degree of the total crossbow is constant at 60 lbs.

According to the above description and the table, the adjustable cam for the crossbow in the present invention has variable modifications in the tension degrees and the draw lengths by adjusting the engagements between the main disk (20) and the blocks (30, 40). Therefore, the crossbow can be adjusted to satisfy different users having different physical conditions.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A adjustable cam for a crossbow, the adjustable cam comprising:

a main disk (20) having two sides;

a group of string hooks (I) formed on one side of the main disk; a group of weight-selecting holes (II) defined through the main disk (20); and a group of length-selecting holes (III) defined through the main disk;

a weight-adjusting block (40) pivotally mounted on the other side of the main disk (20) and having an engaging end 44 selectively engageable in any of the weight-selecting holes (II); and a length-adjusting block (30) pivotally and coaxially mounted between the weight-adjusting block (40) and the main disk (20) and having an engaging end (34) selectively engageable in any of the length-selecting holes (III).

2. The adjustable cam as claimed in claim 1, wherein the main disk (20) is a kidney-shaped plate and has an edge periphery;

a recess (22) defined in one side of the main disk (20) to have the group of string hooks (I) inside and extending to the edge periphery to provide an opening (222) and make the main disk (20) have a C-shaped platform with a pivotal end;

a string rail (26) formed on the edge periphery around the main disk (20) until the string rail (26) closes the opening (222) of the recess (22); and a pivotal hole (24) defined in the pivotal end of the C-shaped platform;

wherein, the group of string hooks (I) is arranged in a curved line;

wherein, the group of weight-selecting holes (II) is arranged in a curved line on the C-shaped platform in parallel with the group of the string hooks (I);

wherein, the group of length-selecting holes (III) is arranged in radius paths relative the length-adjustable block (30) and close to the pivotal hole (24).

3. The adjustable cam as claimed in claim 2, wherein the length-adjusting block (30) is an S-shaped plate and has a pivotal end (32) with a pivotal hole (38);

a sunken area (322) defined at the pivotal end (32) around the pivotal hole (38) to face the weight-adjusting block (40);

an exterior edge formed at the engaging end (34);

a string groove (36) defined along the exterior edge; and a group of length-matching holes (IV) arranged on the engaging end (34) to correspondingly align with the group of length-selecting holes (III) on the main disk (20).

4. The adjustable cam as claimed in claim 3, wherein the weight-adjusting block (40) is a C-shaped plate and has an outer edge;

an inner edge;

a zenith (a) at the outer edge;

a pivotal end (42);

the engaging end (44);

a sunken area (422) defined at the pivotal end (42) to engage with the sunken area (322) on the length-adjusting block (30) and gradually broadening and extending to the inner edge;

a string rail (46) formed on the outer edge of the weight-adjusting block (40) to align with the string groove (36) on the length-adjusting block (30);

a mounting hole (442) defined in the engaging end (44) to selectively align with one corresponding hole in the group of weight-selecting holes (II).

5. The adjustable cam as claimed in claim 4, wherein the group of string hooks (I) has three string hooks (A, B, C);

the group of weight-selecting holes (II) has five weight-selecting holes (1, 2, 3, 4, 5);

the group of length-selecting holes (III) has five length-selecting holes (D, E, F, G, H); and the group of length-matching holes (IV) has five length-matching holes (6, 7, 8, 9, 10).

6. The adjustable cam as claimed in claim 5, wherein the main disk (20) further has a mounting hole (28) defined near the group of weight-selecting holes to adapt to engage with a string wheel (23).

7. The adjustable cam as claimed in claim 1, wherein the length-adjusting block (30) is an S-shaped plate and has a pivotal end (32) with a pivotal hole (38);

a sunken area (322) defined at the pivotal end (32) around the pivotal hole (38) to face the weight-adjusting block (40);

an exterior edge formed at the engaging end (34);

a string groove (36) defined along the exterior edge; and a group of length-matching holes (IV) arranged on the engaging end (34) to correspondingly align with the group of length-selecting holes (III) on the main disk (20).

* * * * *